US005280655A

United States Patent [19]

Holmes

[11] Patent Number: 5,280,655

[45] Date of Patent: Jan. 25, 1994

[54] BATH

[76] Inventor: John W. Holmes, Mews Cottage, Trenance Rd., St. Austell, Cornwall, United Kingdom, Pl 25 5A1

[21] Appl. No.: 964,713

[22] Filed: Oct. 22, 1992

[51] Int. Cl.[5] ..... A47K 3/02

[52] U.S. Cl. ..... 4/564.1

[58] Field of Search ..... 4/495, 540, 546, 538, 4/559, 560.1, 564.1, 565.1, 566.1, 571.1

[56] References Cited

U.S. PATENT DOCUMENTS

| | | | |
|---|---|---|---|
| 2,133,587 | 10/1938 | Stark | 4/566.1 |
| 2,860,349 | 11/1958 | Blomqvist | 4/540 |
| 3,801,995 | 4/1974 | Adamson | 4/564.1 |
| 3,935,600 | 2/1976 | Scribner | 4/495 |
| 4,055,863 | 11/1977 | Duval . | |
| 4,068,326 | 1/1978 | Deschler . | |
| 4,312.084 | 1/1982 | Browning | 4/538 |
| 4,574,408 | 3/1986 | Dentler et al. | 4/560.1 |

*Primary Examiner*—Charles E. Phillips
*Attorney, Agent, or Firm*—Bachman & LaPointe

[57] ABSTRACT

A bath for invalids or elderly people has a sitting member 1 fixedly supported so that a sitting surface thereof is at a convenient height above floor level for a user to sit on, and a raisable and lowerable substantially rigid side surround 3 shaped to extend continuously around the periphery of the sitting surface. The surround is movable between a lowered position in which it is located at least substantially below the sitting surface to allow the user to sit on or get off the sitting surface, and a raised position in which it surrounds and projects above the sitting surface to at least partly define therewith a bath cavity for receiving liquid. The bath may include first seal 16 attached to the sitting member and second seal 17 on or attached to the surround for engaging each other to seal the surround to the sitting member in liquid tight manner in the raised position. A closeable and openable outlet is arranged to facilitate the exit of liquid from the bath cavity. The bath also has a mechanism 100 for ensuring that the side surround moves substantially in a vertical direction between its raised and lowered positions and inflatable air bag 320 located beneath the sitting member and operable upon inflation to raise the side surround 3 into its raised position.

14 Claims, 7 Drawing Sheets

Figure 1:
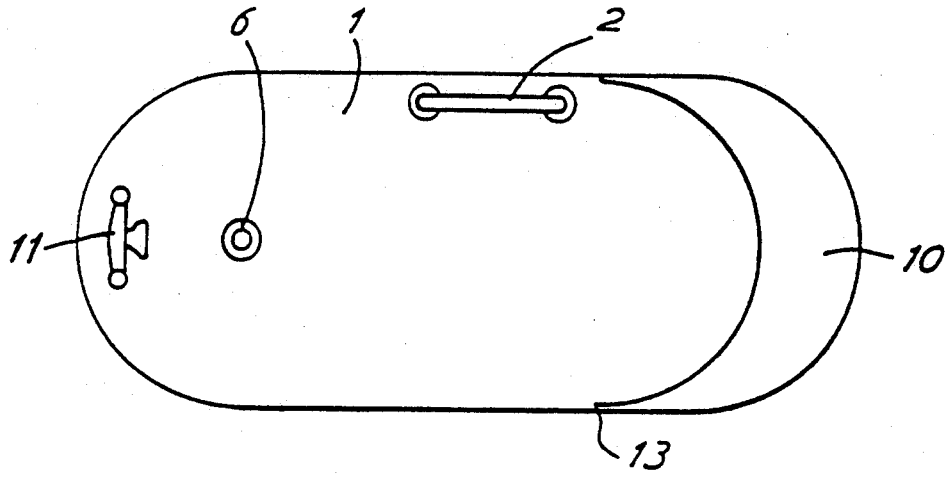

FIG. 8
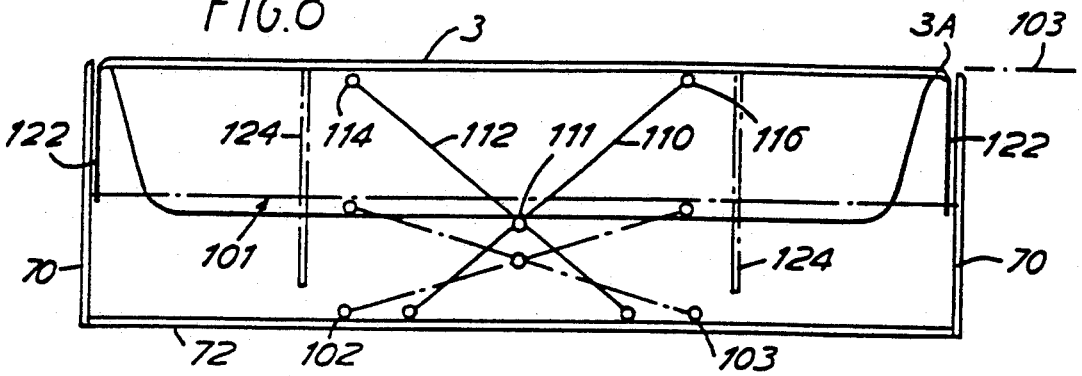
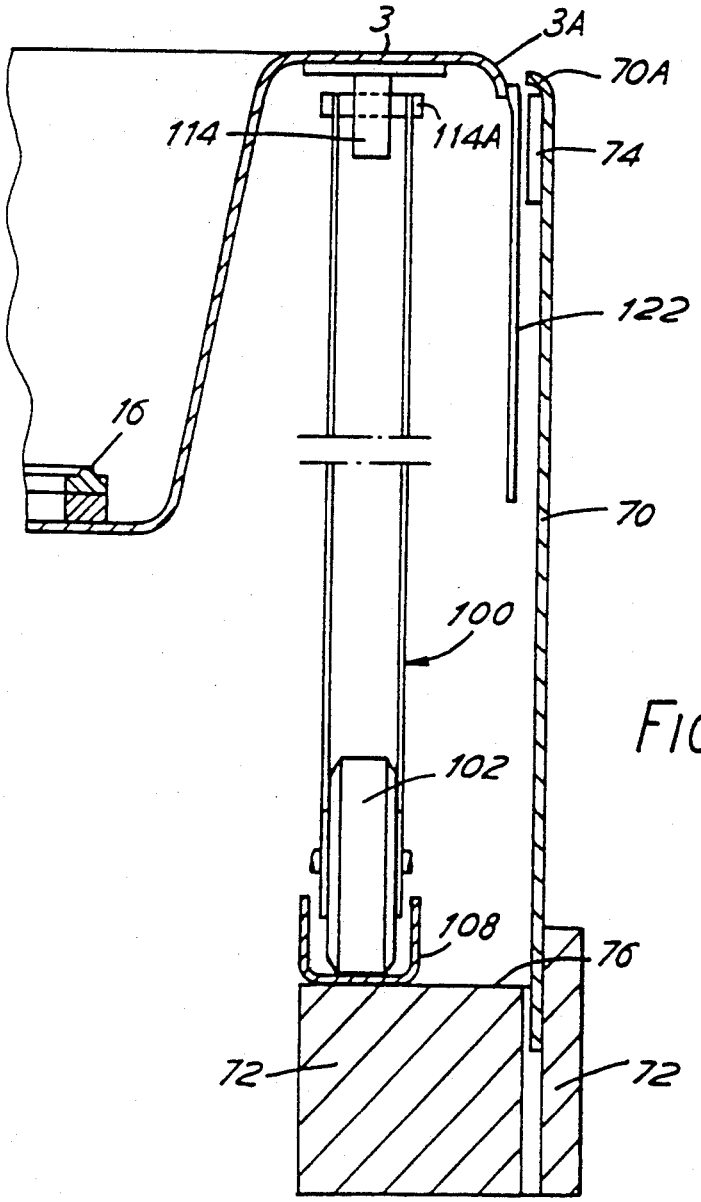
FIG. 9

BATH

This invention relates to a bath and concerns such a bath which is particularly, but not exclusively, suitable for use by or with the elderly, infirm or handicapped.

Use of a conventional bath by the elderly and those with limited use of their legs is difficult without assistance particularly in getting in and out of the bath over the raised side edge or rim and in sitting down and standing up in the bath itself. For a user of limited mobility this difficulty can lead to dangerous accidents by slipping and falling and in some cases a reluctance to use a bath at all with consequent personal hygiene problems.

Efforts have been made in the past to solve this problem by providing a collapsible or inflatable highly flexible structure which retains the bath water around the person. Usually this structure is erected once the person has stepped into, or been laid on a mattress or other support surface. For examples of earlier arrangements, the reader is referred to:

U.K. Patent (GB-A) No. 792 406: 1958
U.K. Patent (GB-A) No. 1 189 785: 1970
U.S. Pat. No. 4,068,326: 1978
U.K. Patent (GB-A) No. 1 506 419: 1978
U.S. Pat. No. 4,312,084: 1982
U.K. Appln. (GB-A) No. 2 100 596: 1983.

These arrangements are mostly intended for hospital or nursing home use and normally require at least one nurse or other competent helper to assist any elderly or infirm person who is seeking to take a bath. Also, these arrangements are reminiscent of baths used for outdoor camping, and, being non-rigid, do not resemble a normal domestic bath. Hence they may well provoke a stubborn reaction, or nervous and negative reaction in elderly or infirm persons. There remains a need for a bath usable by infirm persons, but which gives the user confidence in that it largely resembles a well known conventional bath.

A bathing apparatus for washing (and drying) persons who are bedridden or unable to bathe themselves is disclosed in U.S. Pat. No. 4,055,863 of DUVAL.

There is thus a need for a bath which the elderly, infirm or disabled will find easier to use with or without assistance.

According to the present invention there is provided a bath including: a sitting member fixedly supported so that a sitting surface thereof is at a convenient height above floor level for a user to sit on, a raisable and lowerable member having a substantially rigid side surround shaped to extend continuously around the periphery of the sitting surface, which surround is movable between a lowered position in which it is located sufficiently below the sitting surface to allow the user to sit on or get off the sitting surface, and a raised position in which it surrounds and projects above the sitting surface to define therewith a bath cavity, a seal means attached to the sitting member for engaging the surround, closeable and openable outlet means arranged to facilitate the exit of liquid from the bath cavity, a mechanism for ensuring that the raisable and lowerable member moves substantially in a vertical direction and fluid-expansible bag means located beneath the raisable and lowerable member and operable upon inflation to raise the member into its raised position.

Preferably the sitting surface is fixedly supported on a support surface carried at the required height above floor level on a suitable support means, e.g. a legged frame. The outlet means may be arranged in the sitting surface or in a lower part of the raisable and lowerable member.

Conveniently the sitting surface has a raised back support at one end thereof and preferably is made from plastics material.

The raisable and lowerable member may take the form of a bath-shaped vessel having a base wall connected to or integral with the substantially rigid side surround. This base wall preferably has a plurality of apertures therethrough. Respective substantially vertical posts may extend through these apertures to support the sitting member.

Seal means such as expansible-collapsible gaiters or bellows may be employed to correct the base wall to the underside of the sitting member and prevent any escape of water through the apertures.

Preferably the side surround is oval or elongate with curved ends and of such a height to extend in the lowered position from the floor level substantially to the level of the sitting member peripheral edge.

In one embodiment of the invention, the side surround has an out-turned lip around the upper edge thereof to form a rim for the bath and an inturned lip around the lower edge thereof. This inturned lip cooperates in the raised position with the sitting member.

Advantageously in the same embodiment of the invention one means for sealing the side surround to the sitting member in liquid tight manner in the raised position includes a self centering male seal ring element and a complementary female seal ring element provided one around one of the sitting member and the side surround inturned lip end the other around the other of the sitting member and the side surround inturned lip. There may also be a feather edge flexible lip seal between the sitting member and the inner face of the side surround.

Preferably the male seal ring element is fixedly secured around and to the upper surface of the side surround inturned lip to project upwardly therefrom and the female mating seal ring element is fixedly secured around and to the lower surface of the sitting member near the periphery thereof to depend downwardly therefrom to mate with the male seal ring element in the raised position of the side surround.

Conveniently the feather edge flexible lip seal is strip-like in shape and is fixedly secured along one edge margin thereof to the sitting member so that its free edge margin forming the feather edge extends peripherally away from said member for sliding and wiping engagement with the inner face of the side surround.

The bath includes means, which may be controlled by the bather, for raising and lowering the side surround.

It is preferred that the side surround (or the raisable and lowerable member which includes the side surround) moves substantially vertically. The mechanism for achieving this preferably comprises a scissor link arrangement arranged along each side of the bath.

The fluid-expansible bag means is preferably located to extend beneath substantially the whole of the cross-sectional area of the raisable and lowerable member.

The air bag means is preferably connected to a valve permitting inflation and deflation of the bag means. It may be inflated by air or gas under pressure, or expanded by being filled with a liquid such as water. The valve is desirably controlled by a switch accessible to a person occupying the bath with the side surround raised.

The scissor link arrangement referred to may comprise a scissor link assembly at each side of the bath, each assembly comprising two pivotally connected links and at least the lower end of each link carrying a freely-rotatable roller which runs along a track.

The scissor link arrangement may be locked in the raised and in a half raised position by means of electrically controlled solenoids.

Figure 2:
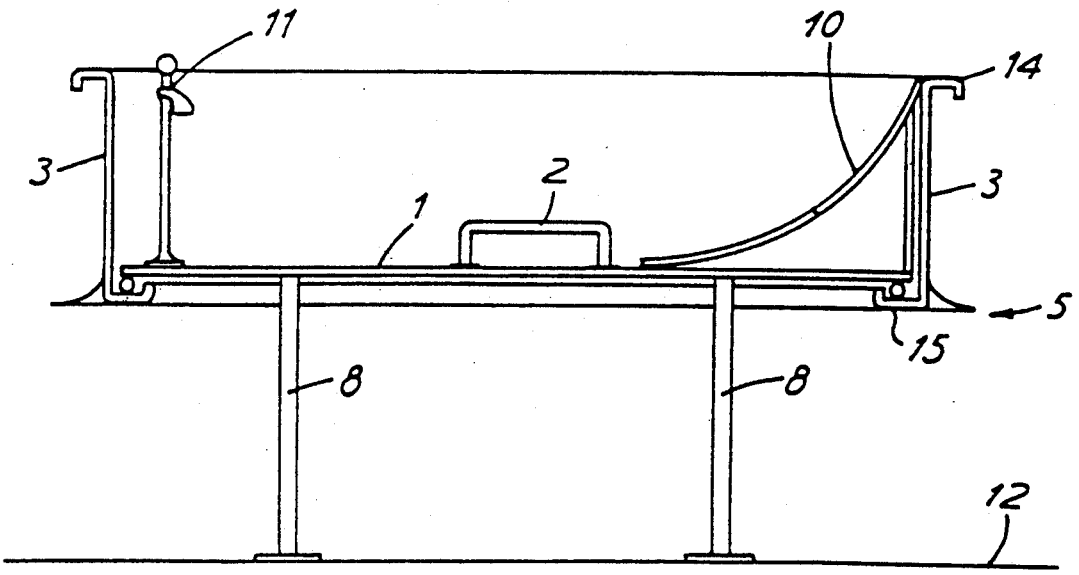
Figure 3:
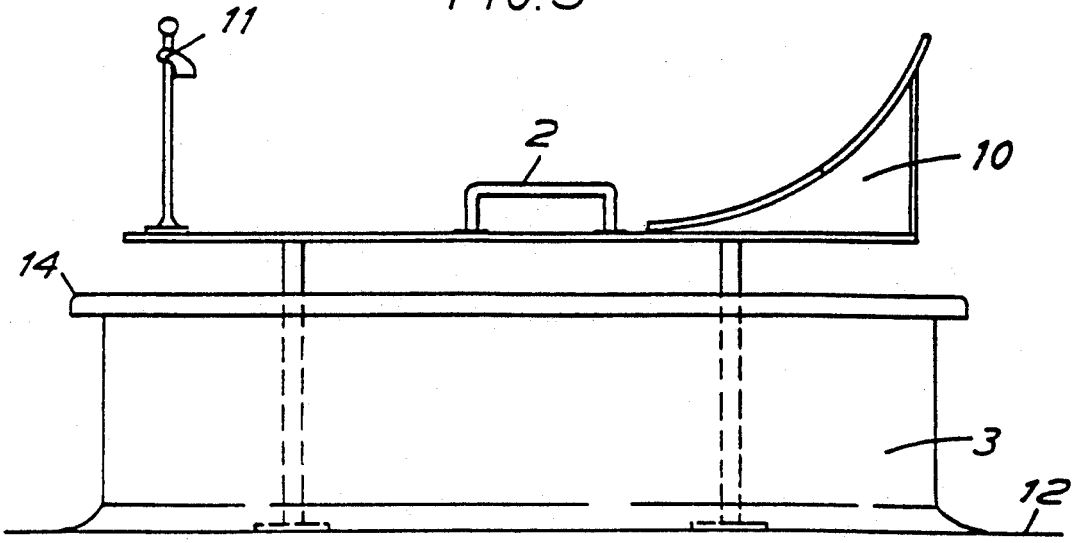
Figure 3:
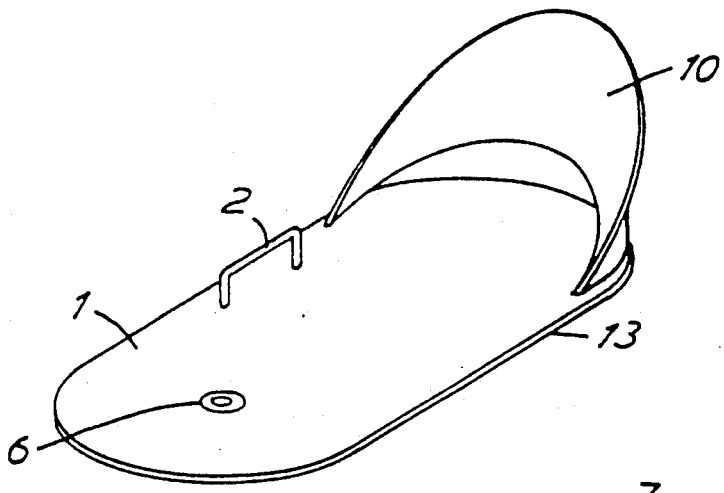
Figure 4:
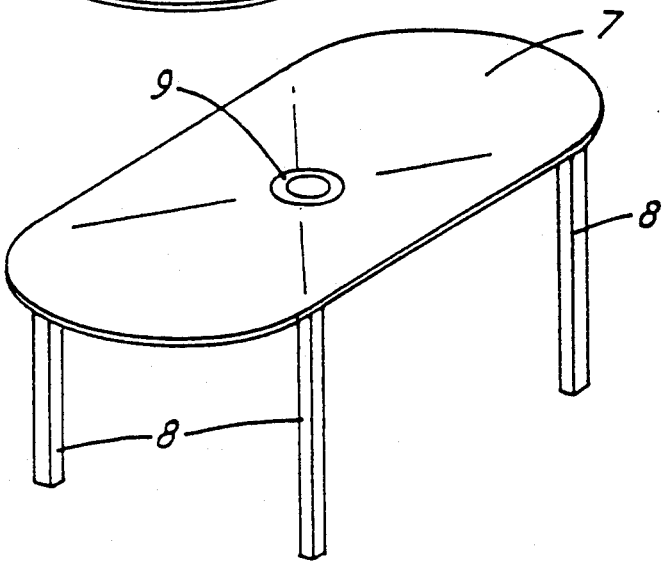
Figure 5:
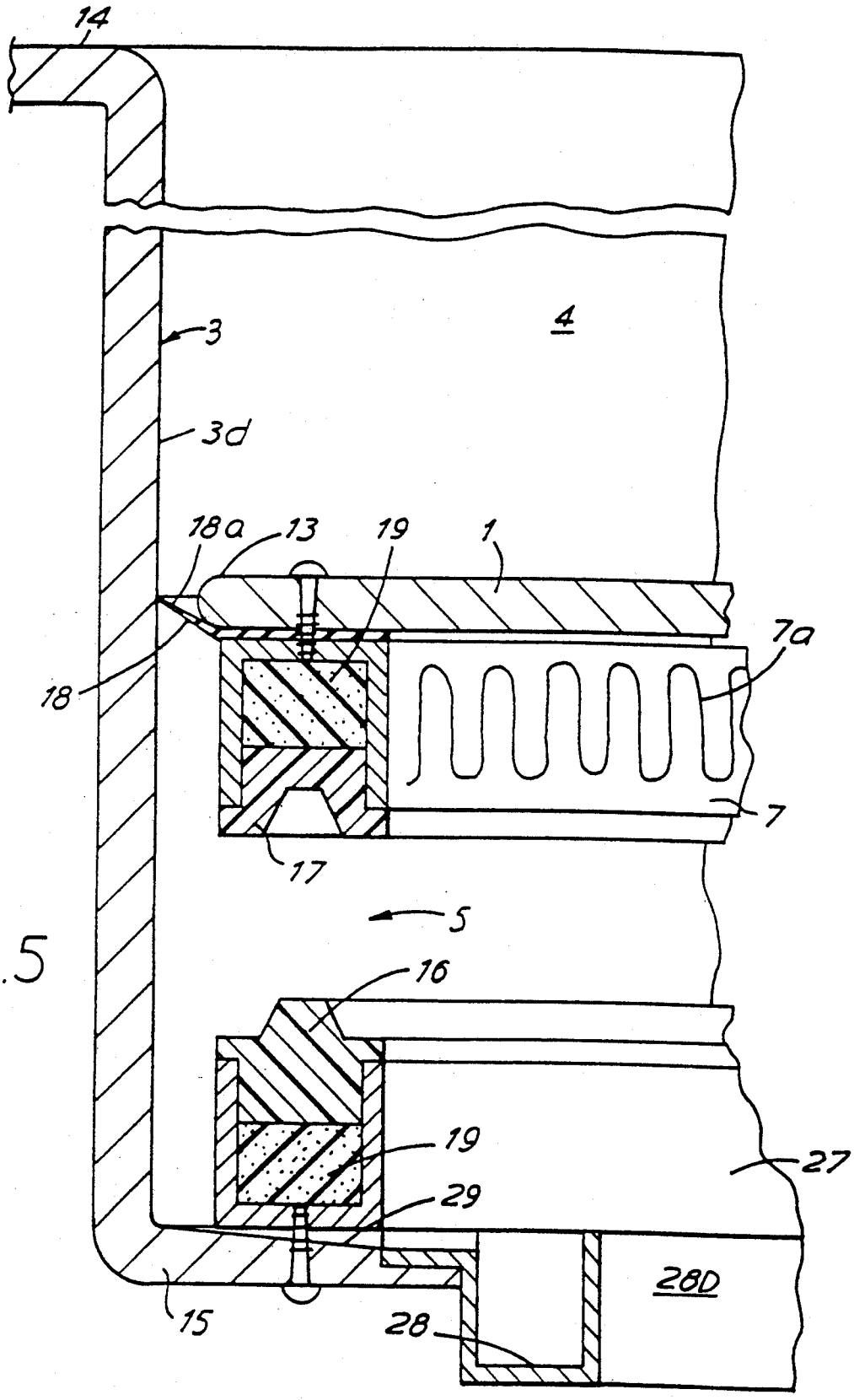
Figure 6:
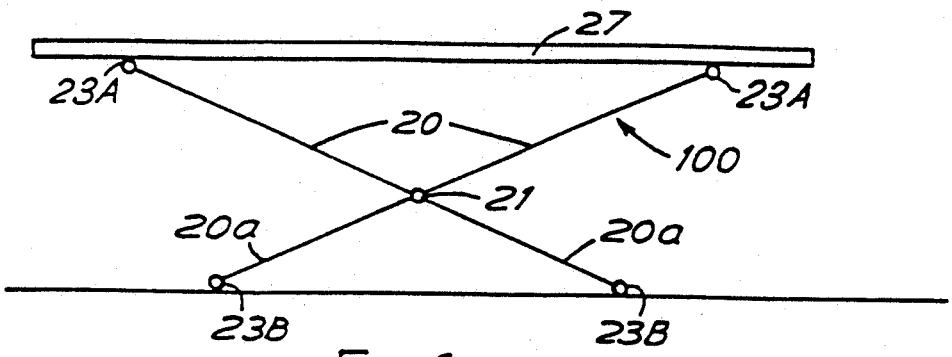
Figure 7:
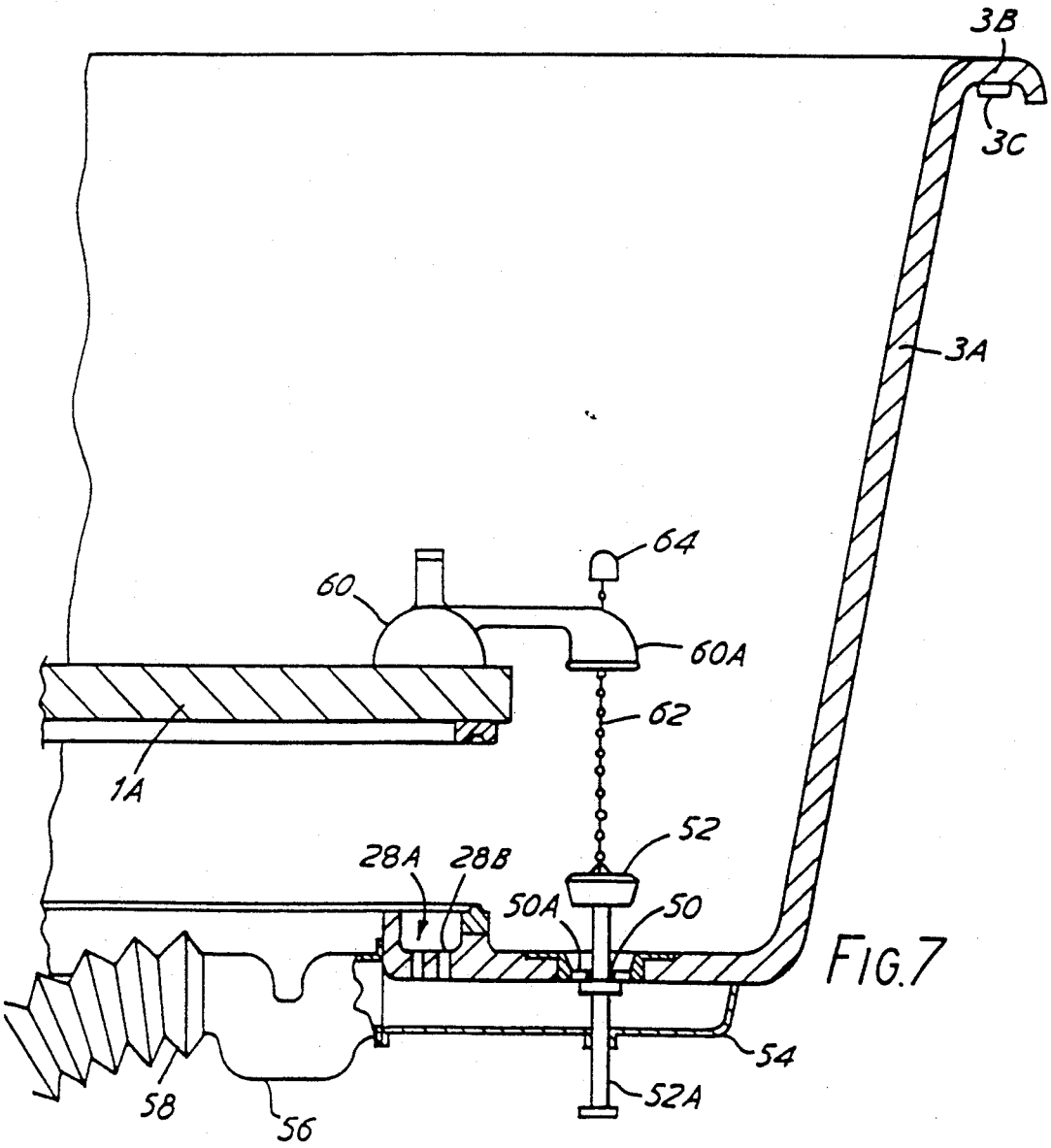
Figure 10:
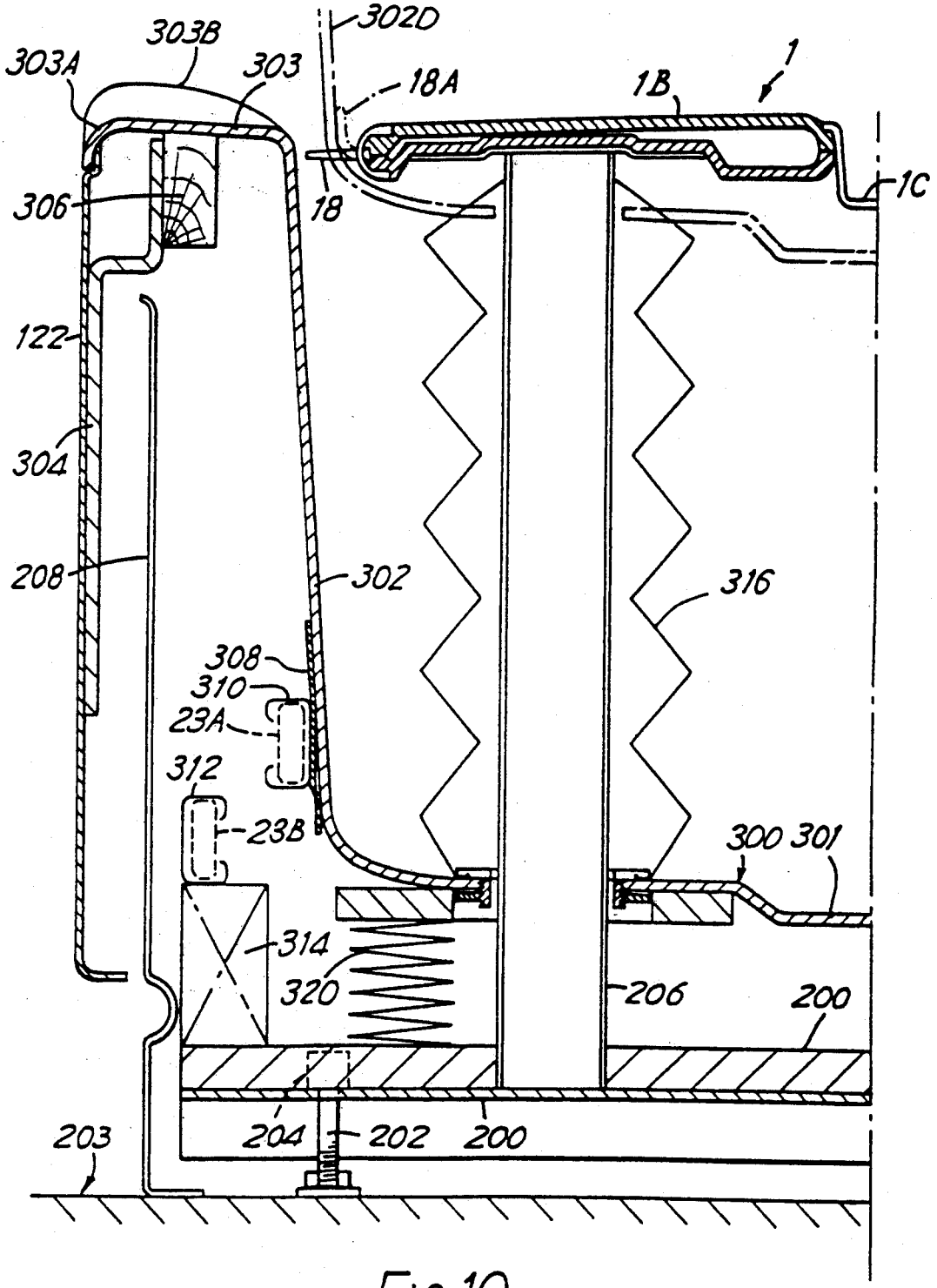

For a better understanding of the present invention and to show how the same may be carried into effect, reference will now be made by way of example, to the accompanying drawings, in which:

FIG. 1 is a plan view of a bath according to one embodiment of the invention seen from above, FIG. 2 is a diagrammatic partially sectioned side view of the bath of FIG. 1 with a side surround thereof shown in a raised position, FIG. 3 is a diagrammatic side view of the bath of FIGS. 1 and 2 with the side surround shown in a lowered position, FIG. 4 is a diagrammatic exploded perspective view of part of the bath of FIGS. 1 to 3, FIG. 5 is a transverse cross-sectional view through part of a bath of FIGS. 1 to 4 to a larger scale showing seal means in a mutually disengaged position, FIG. 6 shows diagrammatically mechanical scissor means for guiding the side surround of the bath during its raising and lowering, FIG. 7 illustrates, in diagrammatic vertical cross section, one form of waste outlet and leakage removal channel, the cross section being taken laterally of the bath but showing one side only;

FIGS. 8 and 9 show one form of scissor link arrangement for guiding the side surround during raising and lowering, FIG. 8 being a diagrammatic side elevation omitting the pelmet and FIG. 9 being a diagrammatic end elevation partly in cross section taken on a plane extending laterally of the bath, FIG. 10 shows a second embodiment of the invention, in a partial cross-section, taken in a vertical plane laterally of the bath, illustrating a member which includes the side surround in respective lowered and raised positions, the latter being showed dotted, and also showing an air bag whose inflation causes the raising movement. Only one side of the bath is shown in FIG. 10.

Figure 11:
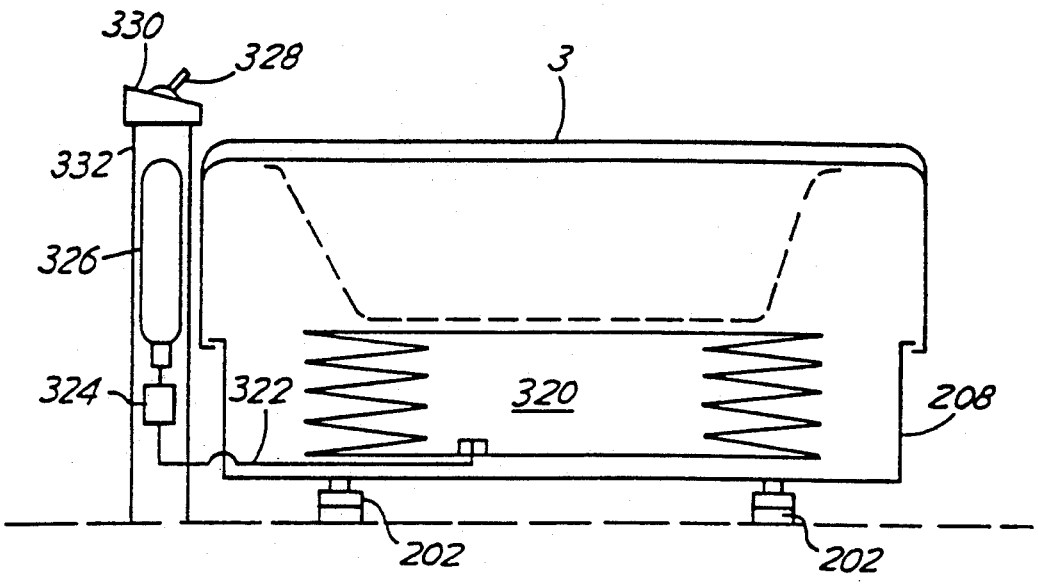

FIG. 11 is a sketch in elevation, not showing the scissor link arrangement, illustrating the position of a fluid-expansible bag means beneath the side surround and one form of control arrangement.

A bath according to an embodiment of the invention as shown in FIGS. 1 to 9 of the accompanying drawings is intended chiefly for use with or by the elderly, infirm or handicapped. The bath includes a sitting member 1 having a sitting surface 1A fixedly supported at a convenient height above floor level for a user to sit on. In this way there is no need to step up over a conventional bath side rim and down into the bath cavity, which movement may be very difficult, if not impossible, for an elderly, infirm or handicapped user to carry out. Hence with the bath of the invention it is merely necessary for a user to sit on the surface 1A and, to swing the body sideways so that the legs slide onto the top of the sitting surface 1A, which conveniently is of elongated form as illustrated. To help in this movement, grab handles may be provided such as the single grab handle 2 illustrated.

The bath of the invention also includes a raisable and lowerable substantially rigid side surround 3 shaped to extend continuously around the periphery of the sitting member 1. The sitting member 1 is preferably also substantially rigid. The side surround 3 and sitting member 1 may be made of any convenient material and are preferably made of reinforced plastics material. The surround 3 is movable between a lowered position as shown in FIG. 3 in which it is located substantially below the sitting surface 1A to allow the user to sit on or get off the sitting surface 1A and a raised position as illustrated in FIG. 2 in which it surrounds and projects above the sitting surface to define therewith a bath cavity 4 for receiving liquid, such as water. Means are provided additionally for sealing the surround 3 to the sitting member 1 in liquid tight manner in the raised position with such sealing means being indicated in more detail in FIGS. 2 and 5. Closable and openable outlets means 6 are also provided in the sitting member 1 for the exit of liquid, such as water, from the bath cavity 4. As an alternative, a liquid drain may be provided in the side surround 3A as seen at 50, 52 in FIG. 7.

Although the bath of the invention has been illustrated as of a conventional elongate form it could of course be of any other desired form such as circular, oval or sector shaped as seen in plan. In one embodiment the elongated sitting member 1 is fixedly supported on a support surface 7 (FIG. 4) carried at the required height above floor level on a legged frame 8. The water outlet means 6 in the member 1 may communicate with further outlet means 9 provided in the support surface 7.

Preferably, as illustrated, the sitting member 1 has a raised back support 10 at one end which also is preferably made from plastics material. Conventional hot and cold water inlet taps may be provided in any convenient position and of any convenient form such as illustrated at 11 in FIGS. 1 to 3.

As illustrated the side surround 3 is approximately annular in cross-section and thus tubular in form having a height such as to extend, in its lowered position, from the floor level 12 substantially to the level of the sitting member peripheral edge 13. The side surround 3 has an outturned lip 14 around the upper edge thereof to form a rim for the bath, and an inturned lip 15 (FIGS. 2 and 5) around the lower edge thereof for co-operation in the raised position with the support surface 7.

One means for sealing the side surround 3 to the sitting surface 1 in liquid tight manner in the raised position may include a self centering male seal ring element 16 (FIG. 5) and a complementary female seal ring element 17 provided one around one of the sitting member 1 and side surround inturned lip 15 and the other around the other of the said member and said lip together with a feather edge flexible lip seal 18 conveniently made of rubber, between the sitting member 1 and the inner face **3*d*** of the side surround.

In the illustrated embodiment the male seal ring element 16 is fixedly secured around and to the upper surface of the side surround inturned lip to project upwardly therefrom and the seal ring element 17 is fixedly secured around and to the lower surface of the member 1 near the periphery thereof to depend downwardly therefrom to mate with the male seal ring element 16 in the raised position of the side surround 3. Conveniently the male and female seal ring elements are made of rubber with a sponge rubber backing 19.

In this embodiment of the invention, the feather edge flexible lip seal 18 is strip like in shape and is fixedly secured along one edge margin thereof to the sitting member 1 in any convenient manner and preferably to the under surface of the base surface, so that its free edge margin 18*a* forming the feather edge extends peripherally away from the member 1 for sliding and wiping engagement with the inner face 3*d* of the side surround 3 as shown in FIG. 5.

The relationship of the side surround 3 and the support member 1 is illustrated in FIGS. 5 and 6. The inturned lip 15 is secured to the frame structure 27 which is located beneath the sitting member 1 and support surface 7 as shown in FIG. 5. The male seal ring element 16 and rubber backing 19 is thus secured both to the lip 15 of the surround 3 and to the frame structure 27. The frame structure 27 is also provided with an overflow channel 28 and overflow grooves 29 are provided in the lip 15 under the seal ring element 16 to conduct into the overflow channel any liquid which should escape down between the side surround 3 and base surface 1 during use of the bath. The overflow channel 28 bounds a hole 28D. Again as illustrated in FIG. 5 the female seal ring element 17 and rubber backing 19 are secured both to the base surface 1 and to the support surface 7 which conveniently contains insulation 7*a*. An air bag means may be used for raising the side surround 3.

FIG. 7 illustrates, in diagrammatic cross-section one form of waste outlet and leakage removal channel. The side surround 3A is provided with a relief channel 28A which extends completely around the surround 3A. The means for achieving vertical reciprocation of the side surround 3A relative to the fixed sitting surface 1A is not shown in FIG. 7. The side surround 3A has an outwardly curved over lip 3B, and a hole 50 closable by a plug 52. The plug shaft 52A is supported by a spider 50A. The hole leads to a conduit chamber 54 on the underside of the surround 3A which (at one or more peripheral locations) is connected to a conventional trap 56. From this, waste bath water passes into a flexible waste pipe 58. At the base of the relief channel 28A there is provided one or more holes 28B which allow water collecting in the relief channel 28A to pass into the conduit chamber 54. Fitted on the sitting surface 1A is a water supply tap 60 (which may be a mixer type tap). The hot and cold water supplies to this are not shown. The tap 60 is located directly above the plug 52. As an optional feature, the plug may be raised and lowered using a chain 62 which passes through a suitable hole in the tap outlet pipe 60A and has on its free end a handle 64. Of course the conduit chamber 54 is sealed around the place where the plug stem 52A passes through its wall. The length of the chain is chosen in accordance with the extent of vertical movement of the surround 3A.

The curved over portion 3B of the side surround 3A has a stiffener 3C on its underside. This extends along the straight portion only of each side of the surround 3A, and provides a contact surface to which is fixed a block forming part of the mechanism which guides the raising and lowering of the side surround.

An arrangement for water overflow may be provided by connecting a conduit which extends up the outer surface of the side surround 3A to the conduit chamber 54 at one peripheral location. This conduit terminates at its upper end in a hole through the side surround 3A. With this arrangement, the hole represents an overflow outlet and if the bath is overfilled, water will exit through the hole and run away to the waste pipe 58 via the chamber 54.

For guiding the lifting and lowering movement of the side surround 3 or 3A, there is provided the scissor link arrangement 100 generally illustrated in FIG. 6. One form of scissor link arrangement will now be described in more detail referring to FIGS. 8 and 9, the former being a diagrammatic side elevation and the latter an end elevation partly in cross-section taken on a plane extending laterally of the bath. Referring firstly to FIG. 9, there is a scissor link assembly 100 at each side of the bath. A side panel 70 of the bath is carried by lower frame member 72 and upper frame member 74, the former extending along the bath side and having most of its upper surface as a flat surface 76 along which runs one roller 102 of the link arrangement 100. The rollers thereof, including the roller 102, may be made of a polyamide plastics material such as "NYLON". The panel 70 may be curved over at the top as seen at 70A to give an aesthetic appearance. The side surround 3 has a curved over lip 3A and carries a seal means 16. The seal means has already been described with reference to FIG. 5. The roller 102 runs freely on a non-rotating axle 104 which extends laterally of the bath and also carries another free running roller (not shown) which runs on the lower frame member at the opposite side of the bath. As illustrated in FIG. 9, a channel shaped track 108 receives and guides the roller 102 (and a like track would be provided on the other side of the bath). In some circumstances it may be possible to dispense with such tracks.

The scissor link assemblies 100 are each arranged substantially in a vertical plane, one at each side of the bath. One scissor link is shown in FIG. 8 and comprises a first link 110 pivoted (111) at an intermediate region to a second link 112. Each of these links has a roller (102 or 103) at its lower end. The two scissor links may be cross-connected by connecting rods or bars (not shown) if desired. The upper ends of the links 110, 112 may be attached by pivot pins (one shown at 114A) to blocks 114, 116 which are fixed to the underside of the turned over edge 3A of the side surround 3. Alternatively, the upper ends of the links 110, 112 may carry respective freely rotatable rollers which run in a rail such as that shown at 310 in FIG. 10.

A pelmet 122, supported if necessary by thin bracing members (not shown) is attached to and extends downwardly from the outer margin of the curved over lip 3A. This pelmet 122 hides and protects the working parts of the scissor link arrangement. This arrangement for guiding the lifting of the side surround ensures a smooth vertical lift, and is trouble free due to its simplicity, and requires very little maintenance.

In an advantageous but not illustrated version of the FIGS. 8 and 9 embodiment, a short portion at each end of each track 108 is sloped upwardly. When, during raising of the side surround, the relevant roller rolls up this sloped portion, the engagement between the seals 16 and 17 is made firmer, so further reducing the possibility of leakage.

In another advantageous embodiment of the invention, the bath includes means for guiding the raising and lowering movement of the raisable and lowerable member 300, and air bag means for raising it. The air bag means for raising the surround 3 of FIG. 9 may act either directly on the undersurface of the surround 3 or on the underside of a floor portion 310 as will be seen from FIG. 10.

Referring now to FIG. 10, which shows one side only of the bath in lateral cross-section, the sitting member 1 is supported by a base 200 having four pedestal screws, one shown at 202, which rest on a floor 203. In order to allow levelling of the bath on an uneven surface, provision is made for a threaded adjustment of each pedestal screw 202 relative to a threaded boss 204, in the base 200, with which the screws 202 engage.

A post 206 extends upwardly from the base 200 and (together with other similar posts) supports the sitting member 1, this member 1 being constructed of a metallic insert 1B placed in a reinforced plastics sheet 1C. Attached to the outer edge of the insert 1B is a feather edge flexible lip seal 18. A side cover panel 208, suitably supported by means not shown, is provided to hide the internal mechanisms.

A raisable and lowerable member 300 includes a side surround 302 in this embodiment of the invention. The member 300 is preferably formed of reinforced plastics material having a floor portion 301, an upwardly extending bath wall portion (or side surround) 302, a bath edge portion 303 which is horizontal or slightly outwardly sloping as illustrated, and an outer lip 303A which mates with the panel 122. The portion 303 slopes up towards one end of the bath as seen at 303B. The panel 122 is attached to the surround 302 by a bracket 304 in turn attached to a block 306 secured to the underside of the bath edge portion 303. A bracket 308 attached to the exterior of the bath wall portion 302 serves to mount a "C" section metal rail 310 in which run the rollers 23A. A similar rail 312 is supported by a block 314 carried by the base 200. The scissor link arrangements 100 (of which these rollers are part) are located one on each side of the bath and guide the movement of the side surround 302 so that it is raised and lowered substantially vertically. A flexible bellows-like gaiter 316 surrounds the post 206 and is connected in a fluid tight manner at its upper and lower ends respectively to the top end of the post 206 and the under surface of the sitting member 1. Of course it will be appreciated that while one post 206 is shown, the sitting member 1 is supported by a suitable number, e.g. four, such posts and each of them has a similar gaiter arrangement, whose main purpose is to retain liquid in the bath cavity. Beneath the floor portion 301 of the member 300 there is located an air bag (or other flexible bag which can be filled with any suitable fluid. The bag is preferably in the form of an expansible bellows and part of its concertina wall is shown at 320 in FIG. 10. The bag extends over substantially the whole of the area beneath the floor portion 301 and has an inlet for air or gas. It rests on the base 200. In use, it is inflated at the appropriate moment, e.g. by a hand pump or by supplying air or gas from a container filled with air or gas under pressure, and this inflation lifts the member 300 from its lowermost position (as illustrated in full lines in FIG. 10) to its uppermost position which is shown chaindotted at 302D. The flexible seal 18 is caused by this movement to take up a sealing configuration shown at 18A. A valve is preferably provided for controlling exit of air or gas from the interior of the bag.

As seen in FIG. 11, in one embodiment of the invention, an air/gas supply line 322 runs from the interior of the bag 320 to a valve 324 which is connected to a cylinder 326 containing air under pressure. The valve 324 is a three-position valve which affords the following possibilities: (i) interior of cylinder 326 connected to interior of air bag 320, so causing inflation of air bag and lifting of the side surround 3, (ii) valve shut trapping air within air bag 320; so preventing descent of side surround while a bath is being taken, additionally the side surround may be maintained in the raised or half-raised position by means of electrical latches controlled by solenoids (not shown); and (iii) valve 324 allows bag contents to vent to atmosphere, so permitting side surround 302 to descend when the electrical latches are cleared. The condition of the valve 324 is controlled by a control switch 328 on a control panel 330. The cylinder 326 may be located within a housing 332 which supports the control panel 330. Once the user has completed his or her bath, the switch 328 is thrown to a position which causes the valve 324 to vent the interior of the air bag 320 to atmosphere and release the latches, whereupon the side surround 302 moves down under gravity to its lowered position.

It will be understood that to use the bath according to this embodiment of the invention, the user merely ensures that the member 300 is in the lowered position, sits on the base surface 1. reclines against the back support 10, holds the grab handle 2 and swings the legs onto the base surface 1. The volume defined by the side surround 302 and floor portion 301 is then filled as needed by turning on the taps 11, with the outlet means 6 closed. The member 300 may then be elevated in the manner already described. These steps are carried out in reverse when the user wishes to leave the bath, with the first action being either to open the outlet means 6 to allow the bath water to run out of the bath cavity or to allow the member 300 to descend, and later open the outlet means 6 when desired. Thus the user can pivot on the sitting surface and swing his/her legs down until his/her feet reach the floor.

Although not illustrated or described the bath may also incorporate hydro-therapy facilities if desired.

What is claimed:

1. A bath including: a sitting member having a sitting surface, said member being fixedly supported so that said sitting surface is at a convenient height above a floor level for a user to sit thereon, a raisable and lowerable member having a substantially rigid side surround shaped to extend continuously around a periphery of the sitting surface, which surround is movable between a lowered position in which it is located sufficiently below the sitting surface to allow the user to sit on or get off the sitting surface, and a raised position in which it surrounds and projects above the sitting surface to define therewith a bath cavity for receiving and holding liquid therein, means for sealing between said surround and said sitting member, closeable and openable outlet means arranged to facilitate the exit of liquid from the bath cavity, a mechanism for ensuring that the raisable and lowerable member moves substantially in a vertical direction and fluid-expansible means located beneath the raisable and lowerable member and operable upon inflation to raise the side surround into its raised position.

2. A bath according to claim 1 in which the sitting member is fixedly supported at the required height above floor level by legs or posts.

3. A bath according to claim 1 in which the side surround has an out-turned lip around the upper edge thereof to form a rim for the bath and an inturned lip around the lower edge thereof for co-operation in the raised position with the sitting member to provide a surface which supports a person having a bath.

4. A bath according to claim 3 in which the means for sealing the side surround to the sitting member in liquid tight manner in the raised position includes a self centering male seal ring element and a complementary female seal ring element provided one around one of the sitting member and side surround inturned lip and the other around the other of the sitting member and the side surround inturned lip, and a feather edge flexible lip seal between the sitting member and the inner face of the side surround.

5. A bath according to claim 4 in which the male seal ring element is fixedly secured around and to the upper surface of the side surround inturned lip to project upwardly therefrom and the female mating seal ring element is fixedly secured and to the lower surface of the sitting member near the periphery thereof to depend downwardly therefrom to mate and seal with the male seal ring element said means for sealing in the raised position of the side surround.

6. A bath according to claim 4 in which the feather edge flexible lip seal is strip-like in shape and is fixedly secured along one edge margin thereof to the sitting member so that its free edge margin forming the feather edge extends peripherally away from the sitting member for sliding and wiping engagement with the inner face of the side surround.

7. A bath according to claim 1 in which the bag means is located to extend beneath substantially the whole of the cross-sectional area of the raisable and lowerable member.

8. A bath according to claim 7 in which the bag means is connected to a valve controlled by a switch accessible to a person occupying the bath with the member including the side surround raised.

9. A bath according to claim 1 in which the side surround is guided in its raising and lowering movement by a scissor link arrangement comprising a scissor link assembly at each side of the bath, each assembly comprising at least two pivotally connected links and at least the lower ends of selected links carrying respective freely-rotatable rollers which run along respective tracks.

10. A bath according to claim 9 in which each end of each track is sloped upwardly so as to improve the sealing action of said means for sealing.

11. A bath according claim 9 in which the side surround is connected to a floor portion, and seals are provided between the floor portion and substantially vertical posts which support the sitting member.

12. A bath according to claim 11 in which the seals between the floor portion and the posts are gaiter-type seals.

13. A bath according to claim 11 in which the side surround and the floor portion are constructed to be capable of containing a liquid in both the raised and lowered positions of the floor portions.

14. A bath according to claim 1 wherein the fluid-expansible means is a fluid-expansible air bag.

* * * * *

UNITED STATES PATENT AND TRADEMARK OFFICE

CERTIFICATE OF CORRECTION

PATENT NO. : 5,280,655

DATED : JANUARY 25, 1994

INVENTOR(S) : JOHN W. HOLMES

It is certified that error appears in the above-indentified patent and that said Letters Patent is hereby corrected as shown below:

In Column 8, claim 1, line 51, after "surrounds and" --at least a portion thereof-- should be inserted;

In Column 9, claim 5, line 17, after "secured" --around-- should be inserted; and In Column 9, claim 5, line 20, "said means for sealing" should be deleted.

Signed and Sealed this

Twenty-first Day of June, 1994

*Attest:*

Bruce Lehman

BRUCE LEHMAN

*Attesting Officer*

*Commissioner of Patents and Trademarks*